US005497851A

United States Patent [19]

Walcher et al.

[11] Patent Number: 5,497,851

[45] Date of Patent: Mar. 12, 1996

[54] PIVOTING WORK PLATFORM

[75] Inventors: James G. Walcher, Willard; Arthur C. Herner, Monroeville, both of Ohio

[73] Assignee: Safety Equipment Inc., Monroeville, Ohio

[21] Appl. No.: 268,150

[22] Filed: Jun. 29, 1994

[51] Int. Cl.[6] ..... E04G 1/00; B66F 11/00

[52] U.S. Cl. ..... 182/223; 182/65; 182/148; 108/901

[58] Field of Search ..... 182/223, 222, 182/141, 148, 63, 65, 62.5, 2; 108/901, 139, 142, 54.1

[56] References Cited

U.S. PATENT DOCUMENTS

| | | | |
|---|---|---|---|
| 2,965,191 | 12/1960 | Balogh | 182/223 X |
| 3,415,339 | 12/1968 | Range | 182/2 |
| 4,356,887 | 11/1982 | Fisher et al. | 182/148 X |
| 4,755,099 | 7/1988 | Belveal | 108/142 X |
| 4,936,414 | 6/1990 | Rybka | 182/63 X |
| 5,018,923 | 5/1991 | Melan et al. | 182/62.5 X |
| 5,109,952 | 5/1992 | Starks et al. | 182/141 X |

FOREIGN PATENT DOCUMENTS

| | | | |
|---|---|---|---|
| 2846157 | 5/1980 | Germany | 108/142 |
| 168004 | 6/1934 | Switzerland | 108/139 |

*Primary Examiner*—Karen J. Chotkowski
*Attorney, Agent, or Firm*—Ralph E. Jocke

[57] ABSTRACT

A lifting platform for elevating workers and materials during construction includes a load supporting deck (12). The deck is supported on a pair of intersecting channels (24). The channels are rotatable about a pin (28) which extends through upper and lower plates (30, 32). A disk shaped member (26) is supported on a lower support frame portion (48). The channels (24) are connected to brackets (40) which include a tab portions (42) which extends beneath the lower face (32) of the of the disk shaped member and is slidably positioned therewith. The platform is rotatable about the disk shaped member and can be fixed in a selected rotational position. The platform may be raised by the lower support frame portion using conventional lifting forks (64) of a forklift truck (66).

22 Claims, 8 Drawing Sheets

PIVOTING WORK PLATFORM

TECHNICAL FIELD

This invention relates to equipment used in construction. Specifically, this invention relates to a platform for lifting workers and materials to an elevated surface, such as a roof. The platform may be rotated to a desired angle to conform with the elevated surface.

BACKGROUND ART

During construction of buildings and other structures, it is often necessary to lift workers and materials to elevated levels. Elevated platforms having substantial length are often desirable in construction so that beams and other members may be carried on the platform. Elongated platforms also allow workers to work on the platform at widely spaced intervals which is sometimes necessary during the construction process.

Elongated lifting platforms are known in the prior art. In construction applications, these lifting platforms have been lifted by ground based vehicles such as forklifts. A problem often occurs because the lifting forks must extend squarely perpendicular underneath the body of the platform. Unfortunately, it is not always possible to position the forklift so that the lifting forks and the platform are positioned at the desired angle, such as flush with the edge of a roof or with the side wall of a building. The inability to perfectly align such lifting platforms can make it more difficult for workers to work or unload the platform and can increase safety risks.

As a result, there exists a need for an elongated lifting platform that can be used to elevate workers or materials, and which can be rotated to conform the deck of the platform with a desired structure regardless of the position of the lift truck or other lifting mechanism.

DISCLOSURE OF INVENTION

It is an object of the present invention to provide a lifting platform for workers and materials.

It is a further object of the present invention to provide an elongated lifting platform that is rotatable.

It is a further object of the present invention to provide a lifting platform that includes a deck that may be aligned with a roof edge or building wall.

It is a further object of the present invention to provide a lifting platform which may be used to provide edge protection for a roof.

It is a further object of the present invention to provide a lifting platform that may be used to store materials thereon while still providing free passage for workers along the length of the platform.

It is a further object of the present invention to provide a lifting platform that is suitable for use with conventional forklift devices.

It is a further object of the present invention to provide a lifting platform that can be locked in position by a worker on the platform.

It is a further object of the present invention to provide a lifting platform that is economical and easy to use.

Further objects of the present invention will be made apparent in the following Best Modes for Carrying Out the Invention and the appended claims.

The foregoing objects are accomplished in the preferred embodiment of the invention by a rotatable elongated load supporting platform. The platform has an elongated horizontally extending deck. The deck is generally rectangular in cross section but includes a widened side section near its central portion. The deck enables material to be stored on the side section while workers may traverse the full length of the deck.

The deck is supported by a cantilever portion that extends horizontally therefrom. The cantilever portion includes a pair of intersecting channel members. The channel members have an upper and a lower plate mounted thereto near the point of intersection. The channel members extend beyond the intersection and form a generally "X" configuration.

The platform further includes a disk shaped member which supports the lower plate and the channel members. The disk shaped member has a flat upper face and a flat lower face. The channel members terminate adjacent to an arcuate edge of the disk shaped member. An "L" shaped bracket extends from each channel member. Each bracket has a tab portion which extends beneath the lower face of the disk shaped member and is slidable thereon.

The disk shaped member is supported on a lower frame portion. The lower frame portion includes a pair of spaced fork accepting channels which are sized to accept the lifting forks of a forklift or other conventional load lifting device. A pair of spanning members extend traversely between the fork accepting channels. A pin extends upward from the spanning members, through the disk shaped member and the upper and lower plates. The channel members are rotatable about the pin.

The cantilever portion of the lifting platform and the connected deck may be rotated to the desired rotational position relative to the forks of the forklift which extend through the lower frame portion. The weight of the load on the deck causes the tab portions to engage the lower face of the disk member. As a result, the load on the deck holds the platform in the desired angular position.

In situations where it is impossible to arrange the forks of the lifting vehicle to a desired position, the platform may be rotated so that a side of the deck is flush up against a surface of a structure under construction. This insures that the workers and the load, are properly positioned to perform the activities desired. Further, the greater the load on the deck the more resistance to rotational movement the platform belongs. As a result, the platform is automatically secured in the desired rotational position.

In an alternative embodiment of the invention, rollers are mounted on the underside of the channel members and are movable on the upper side of the disk shaped member. A friction reducing pad is mounted on the top portion in abutting relation with the lower face of the disk shaped member. This enables the platform to more readily rotate particularly under load.

A locking jack is mounted on the deck. The locking jack has a rod that can be selectively engaged with the upper surface of the disk shaped member. When the rod is engaged with the disk shaped member the platform is securely locked in the rotational position. The platform may be moved to a new rotational position by disengaging the rod of the jack from the disk shaped member, rotating the platform and then re-engaging the rod with the disk shaped member.

BEST MODES FOR CARRYING OUT INVENTION

Figure 1:
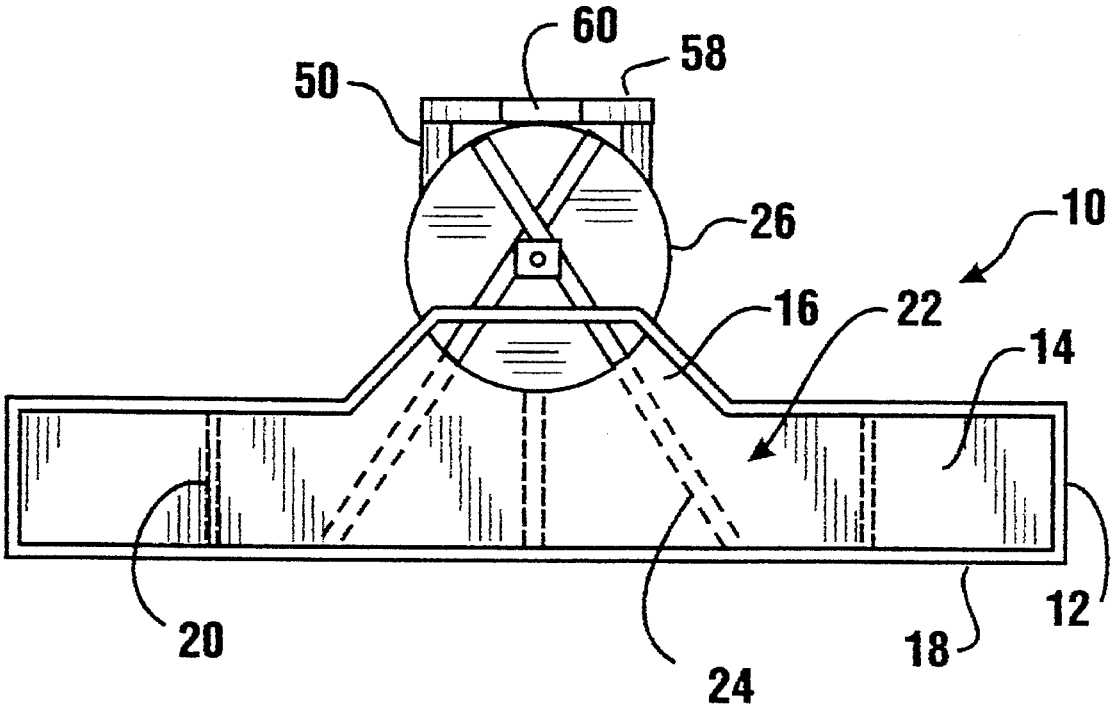
FIG. 1 is a top plan view of the lifting platform of the present invention.
Figure 2:
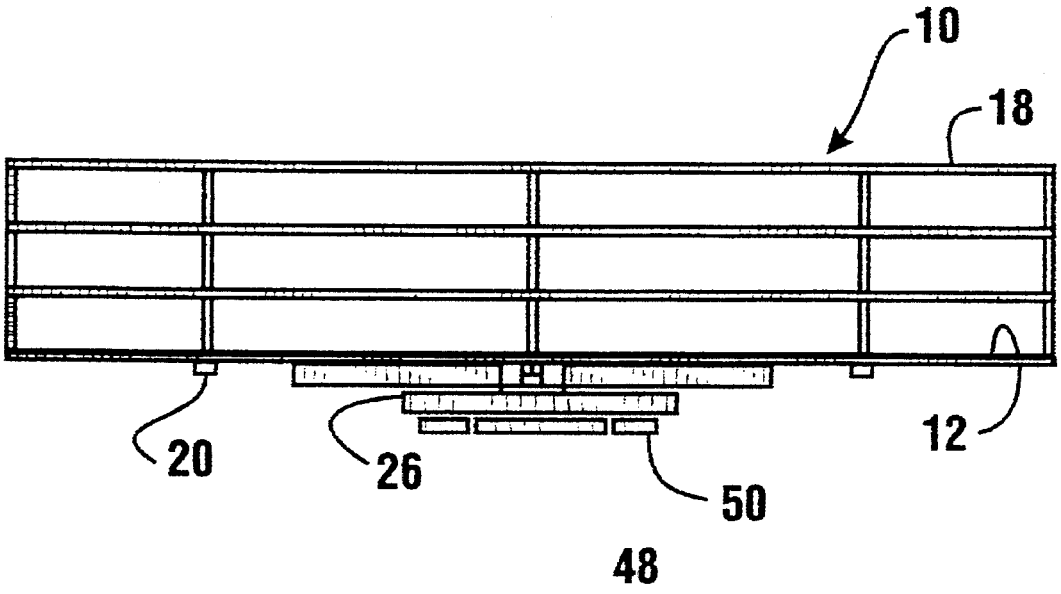
FIG. 2 is a front view of the lifting platform.

Referring now to the drawings and particularly to FIG. 1, there is shown therein a first embodiment of the lifting platform of the present invention generally indicated 10. The platform includes the generally rectangular elongated platform deck 12. Deck 12 includes a longitudinally extending main section 14 and a centrally positioned side section 16. As shown in FIG. 2, deck 12 is bounded by safety rails 18 on all sides to minimize the risk of workers or materials falling from the deck. Deck 12 has a generally flat plate surface and has a plurality of frame supports 20 which extend below the deck plate to provide increased support.

The lifting platform includes a cantilever portion, generally indicated 22. Cantilever portion 22 includes a pair of channels 24. Channels 24 extend in intersecting relation so as to have a configuration in the shape of an "X". The channels are each partially cut away and secured together by welding in the area of intersection to insure strength. The deck is attached to the channels using conventional fasteners.

Figure 4:
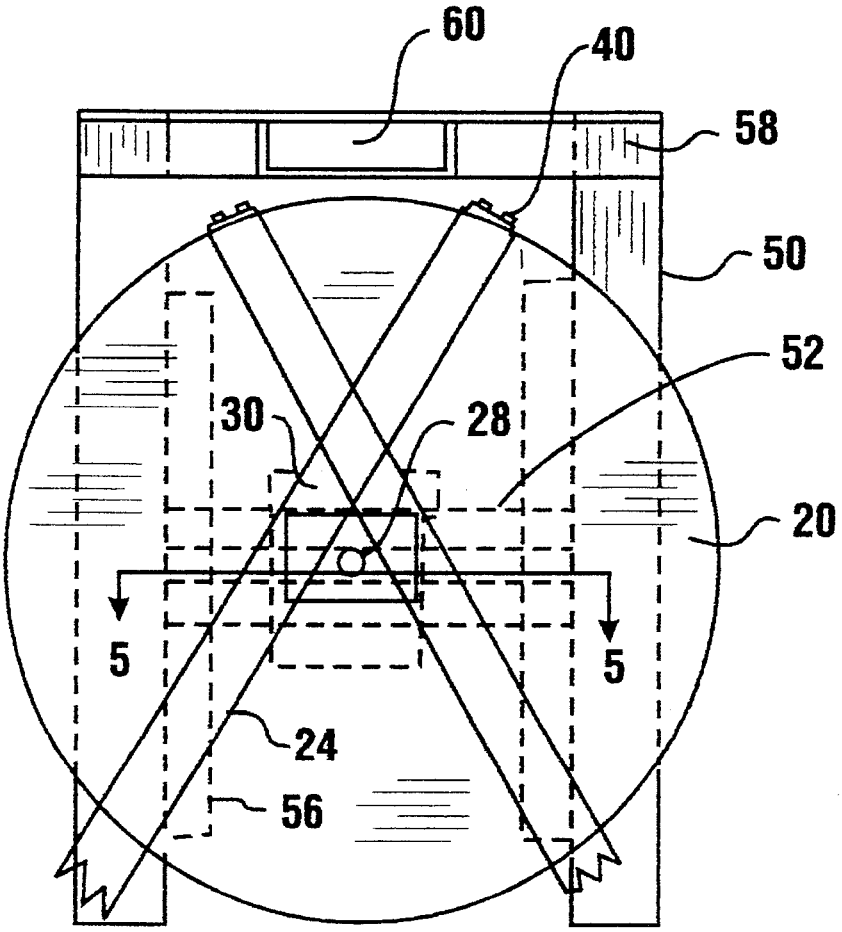
FIG. 4 is a partial top view of the disk shaped member, channel members and lower frame portion of the invention.
Figure 5:
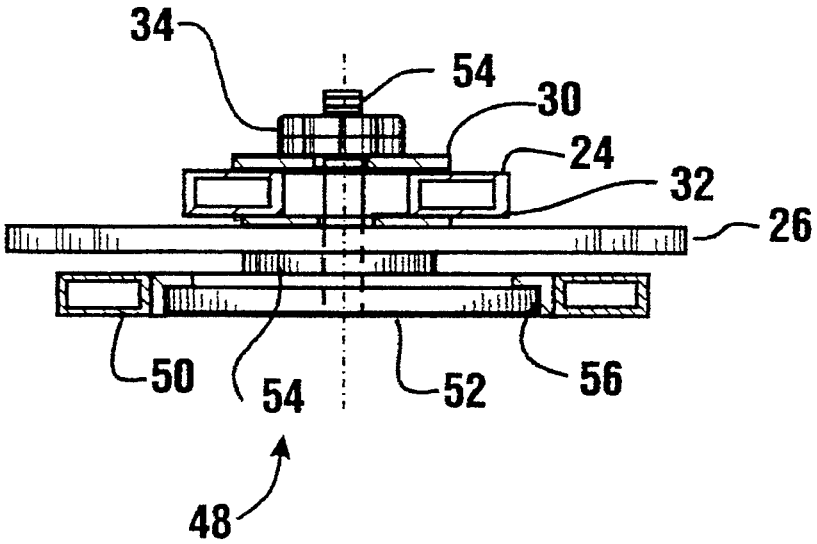
FIG. 5 is a partially sectioned view along line 5—5 in FIG. 4.
Figure 6:
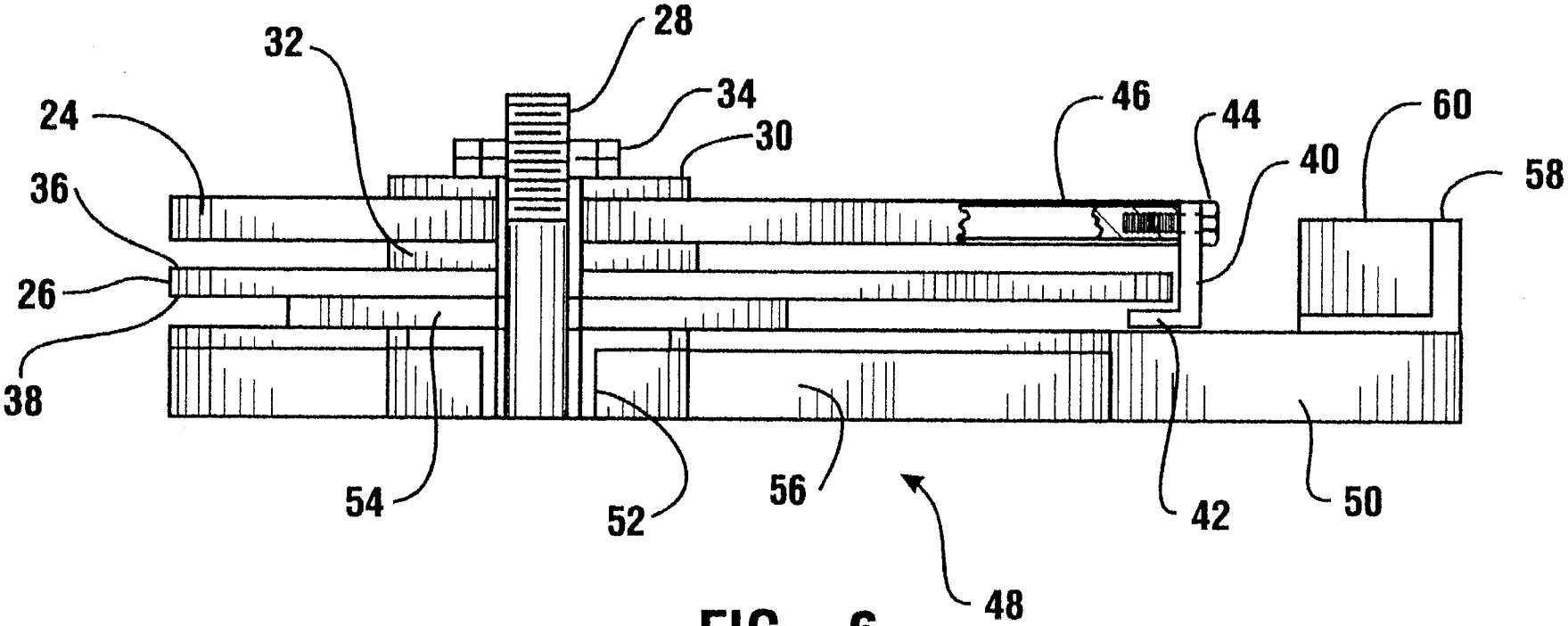
FIG. 6 is a partial cutaway view of the lower frame portion, disk shaped member and channel member.

Channels 24 are supported on a disk shaped member 26. As best shown in FIGS. 4, 5 and 6, a pin 28 extends upward from disk shaped member 26. Channels 24 have welded thereto adjacent the area of intersection, an upper plate 30 and a lower plate 32. As shown in FIG. 6, the upper and lower plates have aligned openings which accept pin member 28. A locking fastener 34 is mounted on pin 28 above the upper plate 30 to hold the channels. Locking fastener 34 is preferably a split locking nut that can be securely fastened to pin 28 or other suitable locking device that will hold the channel members securely but will allow the channel and plate members to rotate about the pin.

Disk shaped member 26 includes a first face 36 on the upper side thereof. Disk shaped member 26 further includes a second face 38 on the lower side thereof. Both faces 36 and 38 are generally planar. First face 36 supports lower plate 32 and the channels 24.

Each channel has mounted thereto a "L" shaped bracket 40. Each "L" shaped bracket has a tab portion 42 that extends adjacent to and below second face 38 of disk shaped member 26. Each bracket 40 is held to the respective channel 24 by a pair of suitable fasteners 44 which are secured to holding blocks 46 inside the channels. Holding blocks 46 are held in position in the channels by welding or other suitable securing means.

Disk shaped member 26 is supported on a lower frame portion, generally indicated 48. Lower frame portion 48 includes a pair of spaced fork accepting channel members 50. Fork accepting members 50 are spaced and have internal passages therethrough which are sized to accept the forks of a conventional forklift truck. Fork accepting members 50 have extending traversely between them a pair of spaced spanning members 52. Spanning members 52 support a rectangular support plate 54. Spanning members 52 further hold pin 28 therebetween. Lower frame portion 48 further includes four supporting angle pieces 56.

A back support member 58 extends between fork accepting members 50 at the rear of the lower frame portion. Back support member 58 has mounted thereon a chain box 60 which is used for holding a safety chain 62 when the chain is not in use. The safety chain is secured to back support member 58 in a conventional manner and is of sufficient strength to hold the platform 10 and the weight carried thereon.

Figure 3:
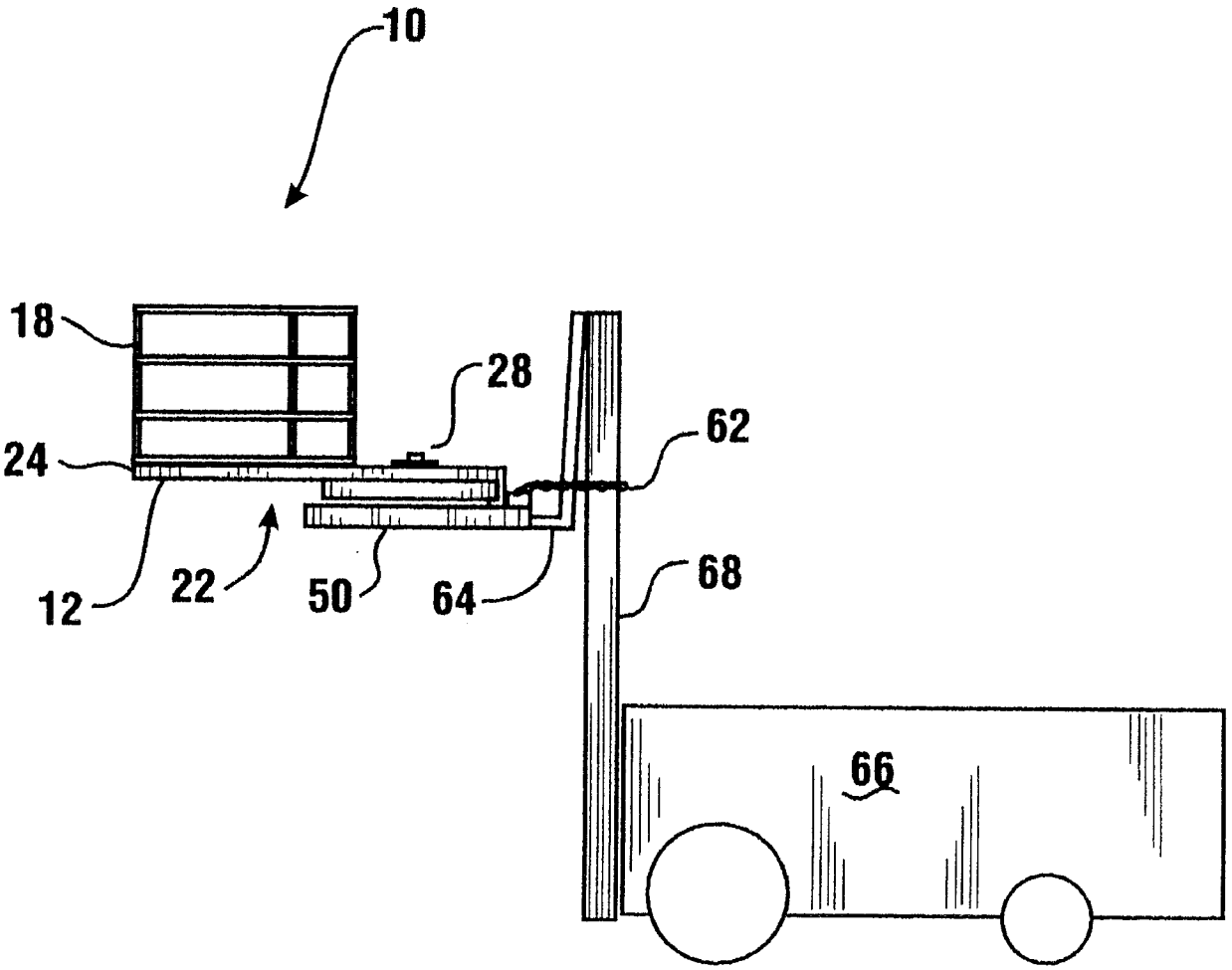
FIG. 3 is a right side view of the lifting platform shown supported by a forklift truck.

As shown in FIG. 3, when the safety platform of the present invention is in use, the lifting forks 64 of a forklift truck 66 are extended into the fork accepting members 50 of the lower frame portion 48. The safety chain 62 is secured about the lifting mast 68 or other suitable area of the lift truck. This minimizes the risk that the platform will disengage from the forks. The platform 10 is then elevated on the forks to the desired height, carrying workers or construction materials or both.

A fundamental advantage of the present invention is that the deck 12 may be rotatably positioned as desired about pin 28. This is accomplished because the channel members 24 and upper and lower plates 30 and 32 may be pivoted about pin 28 to a desired angle. Further, the load carried on deck 12 causes a bending moment about pin 28. This causes brackets 40 to exert a force upwardly and the tab portions 42 to engage the lower face 38 of the disk shaped member 26. As a result, in this first embodiment of the invention the load on the deck serves to prevent rotational movement of the platform.

The lower frame portion 48 of the platform supports the pin 28 and the disk shaped member 26. The pin 28 is secured to spanning members 52 as well as to support plate 54, all of which are formed as a weldment with fork accepting members 50. This provides for a sturdy and durable apparatus.

The present invention is particularly advantageous in construction environments where positioning of the lift truck or other lifting device may be difficult. For example, it may be not possible in many circumstances to position the lifting forks of a lift truck perpendicular to a building wall or roof edge to which the platform must be brought adjacent. In these circumstances, the platform may be pivoted to the desired angle with respect to the forks of a lift truck. The platform can then be locked and retained in this position and workers and materials may be lifted with the platform positioned at the desired angle.

Another advantage of the present invention is that the platform safety rails may be used to help minimize the risk that workers will fall from the edge of a roof. This may be accomplished by positioning the platform adjacent to a roof edge. Because the deck is rotationally positionable, even where the lift truck cannot be ideally positioned, only small gaps are provided between the edge of the roof and the safety rails of the platform.

A further advantage of the preferred embodiment of the present invention is that the side section of the deck can be used to store materials and equipment while maintaining the main section of the deck clear. As a result, workers are free to pass back and forth along the deck, which is often necessary to perform construction activities. In addition, the central portion of the deck above with the generally "X" shaped configuration of the channel members provides support for the stored equipment the central section and allow it to carry heavy loads.

Figure 7:
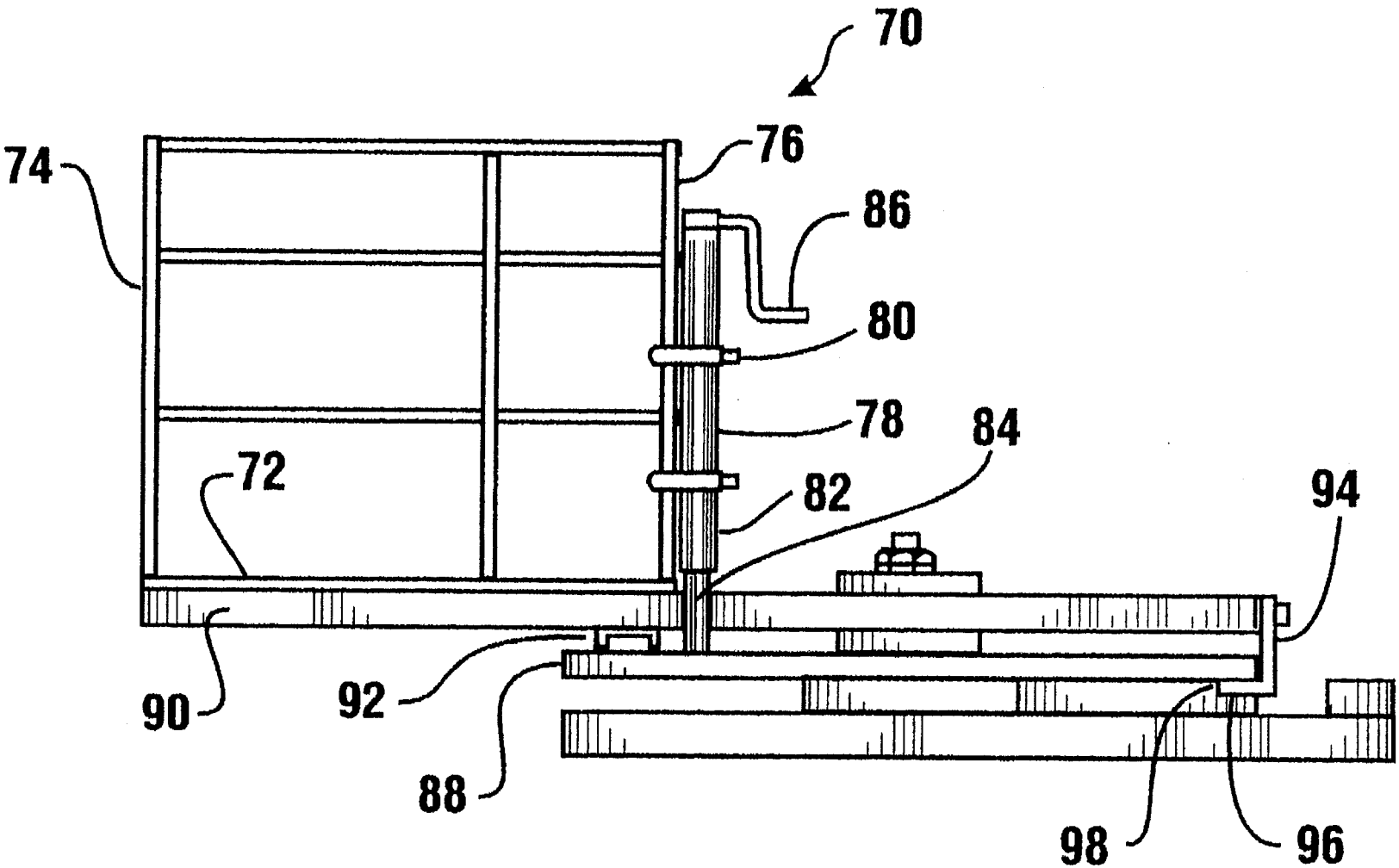
FIG. 7 is a right side view of an alternative embodiment of the lifting platform of the invention.
Figure 8:
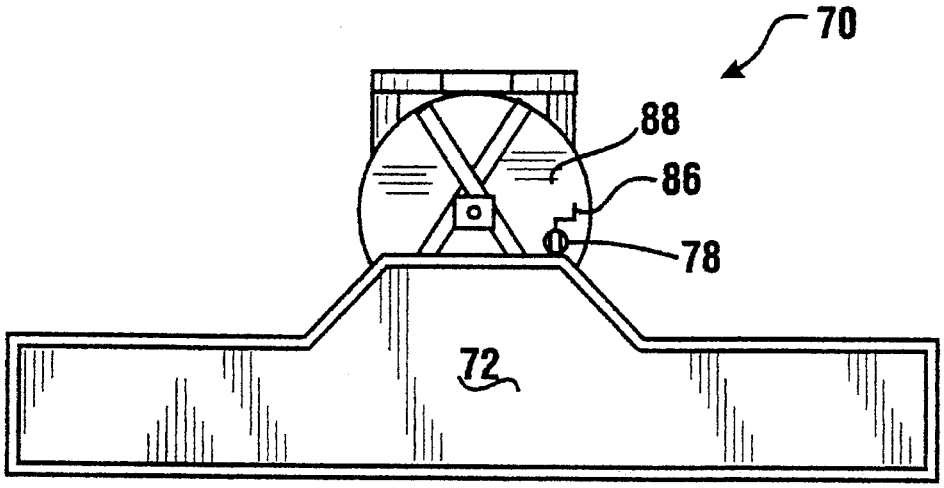
FIG. 8 is a top plan view of the lifting platform of the alternative embodiment shown in FIG. 7.
Figure 9:
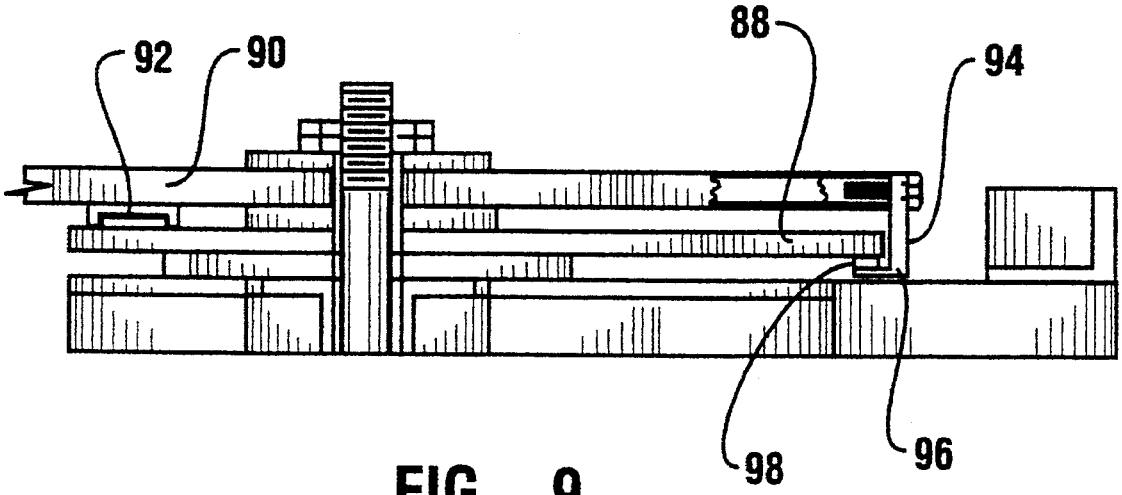
FIG. 9 is a partial cutaway view of the lower frame portion and disk shaped member of the alternative embodiment.

An alternative embodiment of the invention is shown in FIGS. 7 through 9. The alternative embodiment is a rotatable work platform 70. Platform 70 is similar in all respects to platform 10 except as hereafter described.

Platform 70 includes a deck 72 bounded by safety rails 74. One of said upright safety rails 76 has a jack 78 mounted thereto. Jack 78 is mounted to rail 76 by clamps 80. Jack 78 is a conventional jack of the type that is commonly used for raising the tongue of a trailer. It has an outer sleeve 82 and a movable rod 84 that extends downward from the sleeve. Jack 78 includes a rotatable handle 86 which may be used to selectively raise and lower rod 84. Rod 84 is selectively engagable with the upper face of disk shaped member 88.

The deck 72 of the alternative embodiment is supported by channels 90 which extend in an "x" configuration as in the prior embodiment. Each of channels 90 has a roller 92 rotatably mounted thereunder. The rollers 92 are movable on the upper face of disk shaped member 88.

Brackets 94 are mounted at the ends of channels 90. A tab portion 96 extends below the lower face of disk shaped member 88. Tab portion 96 has mounted thereon a friction reducing pad 98 which is engagable with the lower face of disk shaped member 88. Friction reducing pad 98 is comprised of high density polyethylene or other durable, friction reducing material.

In operation, rollers 92 and pads 98 enable the channel members to rotate easily on the disk shaped member 88, even under load. When it is desired to lock the platform in a rotational position, handle 86 is turned so that rod 84 engages disk shaped member 88. Rod 84 then bears part of the load and firmly engages the disk shaped member. Rotational movement of the deck is prevented while the rod is engaged. The deck may be moved to a new rotational position by disengaging the rod from the disk shaped member. This is done by turning handle 86 of jack 78. This can be done by a worker on the deck. Once the platform is rotated to the desired position, the rod is again engaged with the disk shaped member.

The alternative embodiment of the invention has the advantage that the deck can be rotated under load and while elevated. This is particularly advantageous for making adjustments while the platform is in use.

Figure 10:
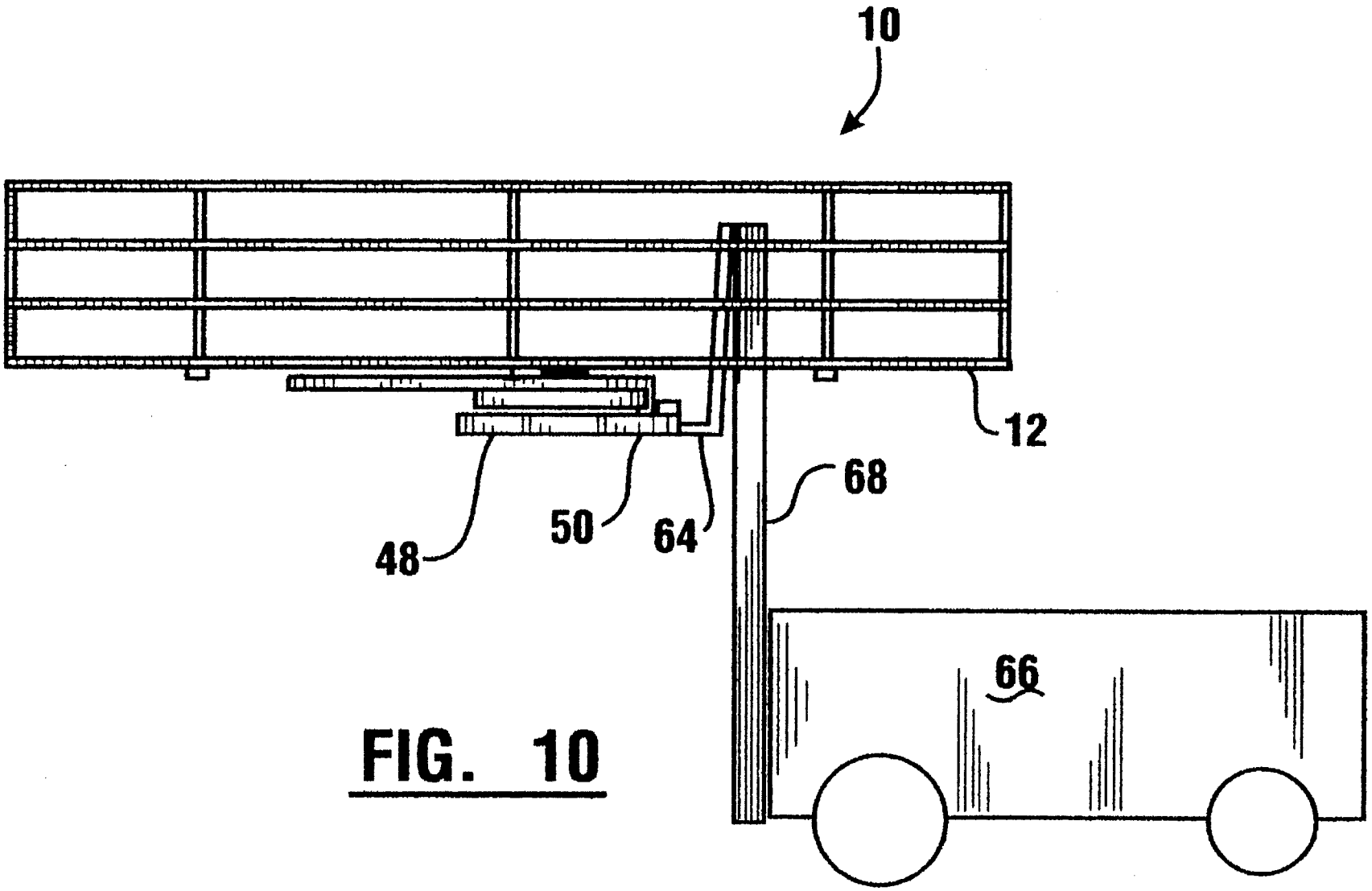
FIG. 10 is a side view of the lifting platform with the deck rotated to extend parallel to the lifting forks of a lift truck.
Figure 11:
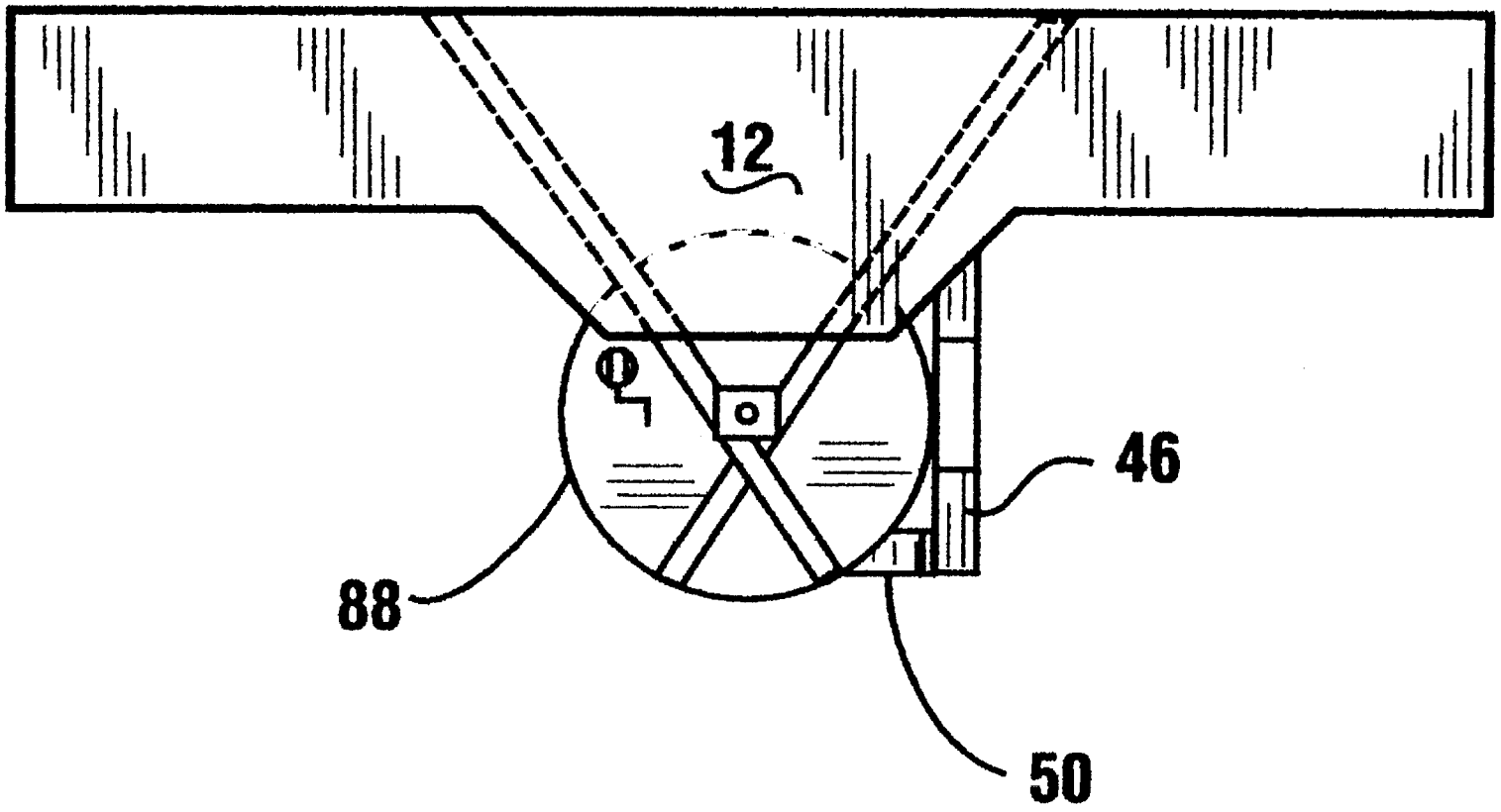
FIG. 11 is a top plan view of the platform in the rotated position shown in FIG. 10.

A fundamental advantage of the invention is that the deck can be rotated through a range of positions extending 180°. As shown in FIGS. 10 and 11 this includes positions in which the main section of the deck extends parallel to the lifting forks of the forklift. This is particularly advantageous for moving the platform along the side of a building or the edge of a roof. The preferred embodiment has the further advantage that the main portion of the deck can be positioned parallel of the lifting forks on either the right or left side of the forklift operator. This provides further lifting and access options.

This advantage of the invention is achieved because the deck is disposed outward on the channels which serve as a cantilevered portion away from the centerline of the rotating means. This enables the lifting forks of a forklift to be accepted in the lower frame portion while still having sufficient clearance for the deck and cantilevered portion to rotate. The result is an extraordinarily useful lifting platform which may be used for a multitude of purposes in a construction environment.

Thus, the new pivoting work platform of the present invention achieves the above stated objectives, eliminates difficulties encountered in the use of prior devices, solves problems and attains the desirable results described herein. The aforementioned locking means, positioning means and supporting means are but preferred embodiments of the invention. Any means which perform function the functions of said locking means, positioning means and supporting means are equivalent means for purposes of the invention.

In the foregoing description, certain terms have been used for brevity, clarity and understanding, however no unnecessary limitations are to be implied therefrom because such terms are for descriptive purposes and are intended to be broadly construed. Moreover, the descriptions and illustrations given herein are by way of examples and the invention is not limited to the details shown and described.

Having described the features, discoveries and principles of the invention, the manner in which it is constructed and operated, and the advantages and useful results attained; the new and useful structures, devices, elements, arrangements, parts, combinations, systems, equipment, operations and relationships are set forth in the appended claims.

We claim:

1. A rotatable elevated load supporting apparatus, comprising:

a load supporting deck;

a support frame supporting said deck, said support frame including a pair of spaced fork accepting members wherein lifting forks are acceptable in said fork accepting members;

rotating means for rotatably moving said deck relative to said frame, said rotating means interposed between said deck and said support frame;

a cantilever portion extending generally horizontal relative to said deck, said cantilever portion having a first end, said first end supporting said deck;

a disk shaped member having a generally horizontally extending first face, said cantilever portion in supported relation with said first face, said disk shaped member further including a second face extending generally parallel and opposed of said first face;

a tab portion attached to a second end of said cantilever portion, wherein said tab portion is engageable with said second face of said disk shaped member.

2. The apparatus according to claim 1 and further comprising:

a pin extending from said disk shaped member generally perpendicular to said first face, said cantilever portion rotatably movable about said pin, and wherein said pin member is positioned intermediate of said tab portion and said deck.

3. The apparatus according to claim 2 wherein said cantilever portion comprises a pair of intersecting longitudinal members extending at an acute angle and intersecting adjacent said pin.

4. The apparatus according to claim 2 wherein said deck comprises a generally rectangular main platform section and a side section extending from said main platform section and towards said pin.

5. The apparatus according to claim 3 wherein said longitudinal members intersect one another intermediate of said pin and said tab portions.

6. The apparatus according to claim 3 and wherein said cantilever portion further comprises an upper plate and a lower plate mounted to said longitudinal members adjacent an intersection of said longitudinal members, and wherein said pin extends through said upper and lower plates.

7. The apparatus according to claim 2 wherein said cantilever portion comprises a pair of intersecting channels, and wherein said channels extend in a generally horizontal direction from said deck, said disk shaped member has an arcuate generally vertically extending edge, each channel member has attached thereto a generally "L" shaped bracket and each said "U" shaped bracket including said tab portion.

8. The apparatus according to claim 7 wherein said cantilever portion further comprises a lower plate positioned intermediate of said channels and said first face of said disk shaped member, said pin extending through said lower plate.

9. The apparatus according to claim 8 wherein said channels are increasingly disposed from one another under said deck with increasing radial distance from said pin.

10. The apparatus according to claim 7 and further comprising support means on said channels for supporting said channels on said disk shaped member, said support means disposed on an opposed side of said pin from said tab portion.

11. The apparatus according to claim 10 wherein said support means comprises a roller on each channel, said roller engaged with said first face of said disk shaped member.

12. The apparatus according the claim 11 and further comprising a friction reducing pad disposed intermediate of said tab portion and said second side of said disk shaped member.

13. The apparatus according to claim 7 and further comprising locking means for selectively preventing rotation of said deck relative to said frame.

14. The apparatus according to claim 13 wherein said locking means comprises a jack mounted on said deck, said jack having a rod selectively engagable with said disk shaped member, whereby rotation of said deck is prevented by engagement of said rod and said disk shaped member.

15. An elevated load supporting apparatus comprising:

a support frame;

a member supported on said support frame, said member having a generally planar upper face, an opposed lower face and an arcuate edge extending traversely of said upper and lower faces;

a first channel, said first channel extending above and adjacent said upper face of said member;

a tab portion connected to said first channel, said tab portion engaging said lower face of said member;

a pin having an axis extending generally perpendicular to said upper face of said member, wherein said first channel is rotatable about said pin and wherein said tab portion is movable in slidable engagement with said lower face of said member upon rotation of said first channel; and a load supporting deck in supported connection with said first channel.

16. The apparatus according to claim 15 wherein said deck is disposed at an opposed end of said channel from said tab portion.

17. The apparatus according to claim 15 wherein said apparatus further comprises a second channel, and wherein said first and second channels intersect above said upper face of said member.

18. The apparatus according to claim 17 wherein said apparatus further comprises a lower plate member mounted to said channels adjacent said intersection, said lower plate extending intermediate of said upper face and said channels, and wherein said pin extends through said lower plate.

19. The apparatus according to claim 17 wherein said channels extend beneath said deck, and wherein said channels are disposed further from one another with increasing radial distance from said pin.

20. The apparatus according to claim 19 wherein said pin extends through said member and is fixably mounted to said support frame, and wherein said support frame includes a pair of fork accepting members and a pair of spanning members extending traversely between said fork accepting members, said pin extending in intermediate and in abutting relation between said spanning members.

21. The apparatus according to claim 20 and further comprising:

rollers rotatably mounted on each of said channel, said rollers supporting said channels on said upper face of said member;

a friction reducing pad mounted on each of said tab portions and in engagement with said lower face;

a jack including a selectively movable rod supported on said deck, wherein said rod is selectively engagable with said member, and wherein in the engaged position of said rod and said member, rotation of said deck relative to said support frame is prevented.

22. A rotatable elevated support apparatus, comprising:

a load supporting deck including an elongated main section;

a support frame, said support from including a pair of spaced fork accepting members wherein lifting forks of a forklift are acceptable in said fork accepting members;

a cantilever member supporting said deck at a first end, said cantilever member being rotatably mounted on said support frame wherein said cantilever member is rotatable about an axis, and wherein said deck is sufficiently disposed from said axis that said deck is rotatable between a first position wherein said main section extends perpendicular to said lifting forks and a second position wherein said main section extends generally parallel to said lifting forks;

a tab portion connected to said cantilever portion at an opposed end, wherein said tab portion slidably engages said frame when said deck is moved between said first and second positions.

* * * * *